US006474800B1

(12) United States Patent
Baitz et al.

(10) Patent No.: US 6,474,800 B1
(45) Date of Patent: Nov. 5, 2002

(54) MATRIX PRINTER AND INTERCHANGEABLE CONTAINER FOR COLOR INK SUPPLY

(75) Inventors: Günter Baitz; Wolfgang Malke, both of Berlin (DE)

(73) Assignee: Wincor Nixdorf GmbH & Co. KG, Paderborn (DE)

( * ) Notice: Subject to any disclaimer, the term of this patent is extended or adjusted under 35 U.S.C. 154(b) by 0 days.

(21) Appl. No.: 09/763,992

(22) PCT Filed: Jul. 26, 1999

(86) PCT No.: PCT/DE99/02289

§ 371 (c)(1),
(2), (4) Date: Feb. 27, 2001

(87) PCT Pub. No.: WO00/12310

PCT Pub. Date: Mar. 9, 2000

(30) Foreign Application Priority Data

Aug. 28, 1998 (DE) ..... 198 39 225

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 5,500,664 A * 3/1996 Suzuki et al. ..... 347/86
5,506,611 A 4/1996 Ujita et al. ..... 347/86
5,757,403 A 5/1998 Nagashima ..... 347/50

FOREIGN PATENT DOCUMENTS

| | | |
|---|---|---|
| DE | 3408302 | 9/1985 |
| DE | 9116990.9 | 1/1995 |
| DE | 19613943 | 10/1997 |
| EP | 0469536 | 2/1992 |
| EP | 0606047 | 7/1994 |
| EP | 0710568 | 5/1996 |
| EP | 0816098 | 1/1998 |
| EP | 0860285 | 8/1998 |

* cited by examiner

*Primary Examiner*—Anh T. N. Vo
(74) *Attorney, Agent, or Firm*—McCormick, Paulding & Huber LLP

(57) ABSTRACT

In an inkjet printer having at least one interchangeable container (16) for printing ink, having a holder (10) to hold the interchangeable container (16), having a switching device to block and enable the inkjet printer, having a signal transmitter (24) and a signal receiver (28) connected to the switching device, which are arranged on the holder (10), and having a signal transmitting device, on the interchangeable container (16), which transmits an enable signal from the signal transmitter (24) to the signal receiver (28) during or after the insertion of the interchangeable container (16) into the holder, the signal transmitting device is arranged in the interior of the interchangeable container (16) and has a signal input (38), a signal transmission element (40) and a signal output (48).

14 Claims, 3 Drawing Sheets

MATRIX PRINTER AND INTERCHANGEABLE CONTAINER FOR COLOR INK SUPPLY

CROSS-REFERENCE TO RELATED APPLICATIONS

This application is entitled to the benefit of and incorporates by reference essential subject matter disclosed in International Patent Application No. PCT/DE99/02289 filed on Jul. 26, 1999 and German Patent Application No. 19839225.7 filed on Aug. 28, 1998.

FIELD OF THE INVENTION

The invention relates to a matrix printer using interchangeable ink container and having a means for preventing operation of the printer with an improper ink container.

BACKGROUND OF THE INVENTION

A matrix printer of this type, designed as an inkjet printer, is disclosed by the document EP 0 606 047 A2. Its print head has a relatively small supply volume for ink, which is connected via a flexible connecting line to an interchangeable container which contains a larger ink supply. The printing ink is led out of the interchangeable container, through the connecting line, into the supply volume of the print head. As a result, the inkjet printer can carry out print jobs with very high ink consumption without the printing operation being interrupted to refill the supply volume or to replace the print head.

Although the known inkjet printer starts a printing operation even when no interchangeable container is connected to the supply volume in the print head, in this case there is the risk that particularly long print jobs will be carried out only incompletely and/or erroneously and will therefore have to be repeated.

U.S. Pat. No. 5,506,611 describes an inkjet printer and an interchangeable ink container that can be operated therein. In order to verify the proper arrangement of the ink container inside a holder belonging to the printer, inter alia a reporting system is proposed which is constructed as follows: provided on the printer is a shaft-like holder, into whose clear space a projection projects. Provided on the upper side of the ink container is an opening which is closed by a displaceable cover. When the ink container is inserted into the holder, the cover is held back by the projection, so that the opening in the upper side of the ink container is opened as the ink container is inserted further into the holder. This releases the pivoting path of a flag which, being driven by a spring, swings out of the ink container and penetrates into a forked light barrier. The latter reports the presence of an ink container in the printer to a printer control system.

A further drawback is that an interchangeable container with ink unsuitable for the operation of the inkjet printer can also be inserted into the holder, and makes the print head unserviceable or damages it permanently.

DE 91 16 990 U1 has therefore proposed to apply to the surface of an ink container a pattern of lines which connects two contacts arranged on a container holder when the ink container is put correctly into the container holder. The making of contact is reported to a control unit, which for its part enables the printing operation. In the case of this arrangement, it is also disadvantageous that, by means of the improper connection of the contacts, it is possible to feign a proper ink container which, however, contains an ink which is unsuitable for the printer. On the other hand, in the event of relatively long use of one and the same ink container, oxidation of the pattern of lines and of the contacts can occur.

U.S. Pat. No. 5,506,611 describes an inkjet printer and an interchangeable ink container that can be operated therein. In order to verify the proper arrangement of the ink container inside a holder belonging to the printer, inter alia a reporting system is proposed which is constructed as follows: provided on the printer is a shaft-like holder, into whose clear space a projection projects. Provided on the upper side of the ink container is an opening which is closed by a displaceable cover. When the ink container is inserted into the holder, the cover is held back by the projection, so that the opening in the upper side of the ink container is opened as the ink container is inserted further into the holder. This releases the pivoting path of a flag which, being driven by a spring, swings out of the ink container and penetrates into a forked light barrier. The latter reports the presence of an ink container in the printer to a printer control system.

It is the object of the invention to configure a matrix printer of the type mentioned at the beginning, and an interchangeable container for printing ink to be used with said printer, in such a way that the printing operation can be enabled or blocked reliably if no interchangeable container, or an unsuitable one, is inserted into the holder.

SUMMARY OF THE INVENTION

This object is achieved by a matrix printer having the features of claim 1. Advantageous developments of the invention are specified in the dependent claims.

In order to block and enable the printing operation, the matrix printer according to the invention has a signal transmitter and a signal receiver, which are formed on the holder, and also a signal transmitting device which is arranged on the interchangeable container. The receipt of an enable signal, emitted by the signal transmitter, by the signal receiver is interrupted as long as the interchangeable container having the signal transmitting device is not inserted into the holder. The printing operation remains blocked and is enabled only when the signal transmitting device of the interchangeable container, when the container is inserted completely into the holder, passes on the enable signal to the signal receiver.

The invention therefore firstly ensures that the printing operation is enabled only when an interchangeable container having the above-described equipment is inserted into the holder. Secondly, an interchangeable container without the signal transmitting device cannot be operated with the matrix printer. In this way, the matrix printer is therefore simultaneously protected against the use of an interchangeable container with unsuitable printing ink, which does not have the signal transmitting device.

There is interaction between a signal input, a signal transmitting device and a signal output. The arrangement of signal input and signal output is made in such a way that the enable signal can be transmitted from the signal transmitter to the signal receiver on the holder. This arrangement makes the signal transmitting device particularly robust against external influences. In addition, the inkjet printer and the interchangeable container, as a result of the precisely defined mutual arrangement of signal transmitter and signal input, on the one hand, and signal output and signal receiver, on the other hand, and also a corresponding arrangement and configuration of the signal transmission element, bear additional features which protect against the use of unsuitable interchangeable containers.

It is advantageous that the signal transmitting device in the interchangeable container is mounted separately from the ink supply. As a result, it is protected against possible damaging effects of the printing ink, and otherwise necessary devices for sealing the interchangeable container at the signal input and at the signal output are dispensed with.

The use and transmission of a mechanical enable signal provides a particularly simple and robust embodiment of the inkjet printer and of the interchangeable container. In this connection, a mechanical signal is understood to mean a symbol transmitted by the transport of movement energy or potential energy in a system of coupled mechanical components and having a specific significance. The signal transmitter protrudes from a side of the holder that faces the interchangeable container, engages in the signal input of the interchangeable container when the latter is inserted and comes into contact with a transmission element which can be moved counter to spring force. During further insertion, the transmission element is forced by the signal transmitter and counter to the spring force to execute a movement by means of which it is pressed against the signal receiver, which is a switching element which is connected to the switching device and is prestressed into an opened position. When the interchangeable container has been inserted completely into the holder, the switching element is displaced by the transmission element into a closed position, in which the printing operation is enabled. In the case of this embodiment, therefore, it is not possible to insert an interchangeable container with unsuitable printing ink completely into the holder, which firstly protects the printer and secondly indicates clearly to the operator of the printer that he is trying to insert an interchangeable container with unsuitable printing ink.

In particular, the signal transmitter can be designed as a pin and the transmission element as a pivoting lever, whose axis of rotation runs transversely with respect to the insertion direction and on whose one arm the pin acts. As a result, the pin simultaneously fulfils the task of a signal transmitter and that of a guide element as the interchangeable container is inserted into the holder. Furthermore, a different type of matrix printer, which is serviceable only with a specific different sort of printing ink, can be protected in a particularly simple way against the use of unsuitable interchangeable containers by means of a slight alteration to the position of the pin on the holder and a corresponding alteration in the arrangement of the signal input and of the pivoting lever in the interchangeable container during the production of said printer.

The matrix printer can be both an inkjet printer and a dot matrix printer. In the first case, the interchangeable container is designed as an ink container and, in the second case, as an ink ribbon cartridge. Both types of printer can be damaged by an unsuitable ink or ink ribbon impregnation. The invention offers reliable protection for both.

BRIEF DESCRIPTION OF THE DRAWINGS

In the following text, two exemplary embodiments of the invention will be explained with reference to the drawing, in which.

DESCRIPTION OF THE PREFERRED EMBODIMENT

Figure 1:
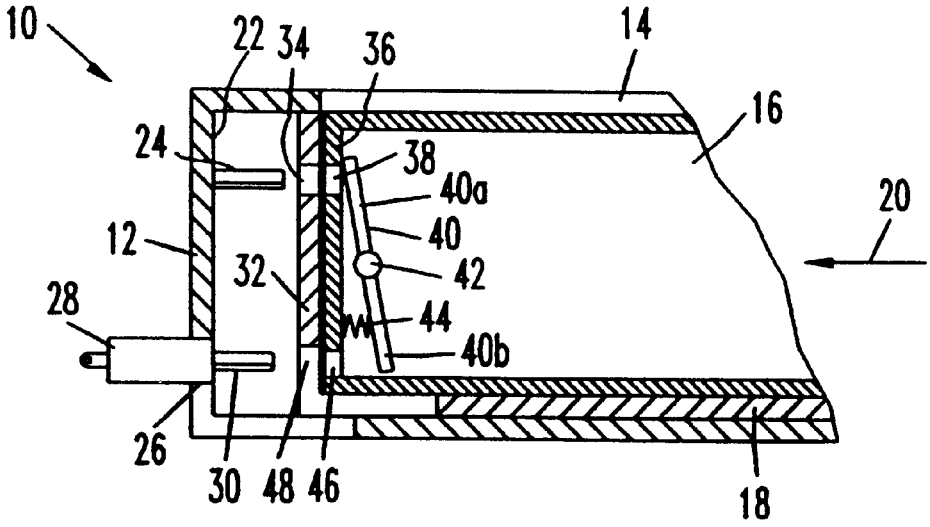
FIG. 1 shows a longitudinally sectioned view of a part of a holder with an interchangeable container in its released position in accordance with a first exemplary embodiment of the invention.

FIG. 1 shows a holder 10 for use in an inkjet printer according to a first exemplary embodiment of the invention. As viewed in longitudinal section, the holder 10 has a rectangular frame 12 having a first opening 14 on its upper side, which is used for the insertion and withdrawal of an interchangeable container 16. During the insertion operation, the inter changeable container 16 is firstly put loosely from above, through the opening 14, into a compartment 18 which is arranged inside the frame 12 and can be displaced in the latter in an insertion direction 20.

A side wall 22 of the frame 12, arranged on the left in the illustration of FIG. 1, has on its inner surface, which points in the direction opposite to the insertion direction 20, a pin 24 which, at approximately a right angle to the inner surface, protrudes from the latter in the direction of the compartment 18. Likewise formed on the left-hand side wall 22, underneath the pin 24, is an opening 26. It accommodates an electrical switch 28 having a signal receiver in the form of a switching pin 30 which is prestressed elastically into an opened position of the switch 28 and can be moved in the direction 20 counter to a spring force, and which is approximately the same length as the pin 24.

Formed on a left-hand side wall 32 of the moveable compartment 18 and a left-hand side wall 36 of the interchangeable container 16 are, respectively, an upper opening 34 and 38. The upper openings 34 and 38, as viewed in cross section, have a shape that corresponds to the cross-sectional shape of the pin 24 and are aligned with the latter when the interchangeable container is inserted into the compartment 18.

In the interior of the interchangeable container 16, a transmitting device in the form of a two-arm pivoting lever 40 is mounted such that it can be rotated about its axis of rotation 42, its upper and lower arms 40*a* and 40*b* protruding to an approximately equal length from the axis of rotation 42. The axis of rotation 42 runs horizontally and, at the same time, transversely with respect to the insertion direction 20, and is mounted on the interchangeable container 16 close to the side wall 36 and, as viewed in a vertical direction, approximately centrally.

A compression spring 44 is fixed at one end to the lower arm 40*b* of the pivoting lever and at the other end to the left-hand side wall 36 of the interchangeable container 16. As a result, the pivoting lever 40 is prestressed into a position in which the upper arm 40*a* rests with its upper end on the left-hand side wall 36 of the interchangeable container 16, above the opening 38. An opening 46 and 48, respectively, is in each case formed on the left-hand side wall 36 of the interchangeable container 16 and the left-hand side wall of the compartment 18, which is adjacent in the insertion direction 20, opposite the lower end of the lower arm 40*b* of the pivoting lever 40.

Figure 2:
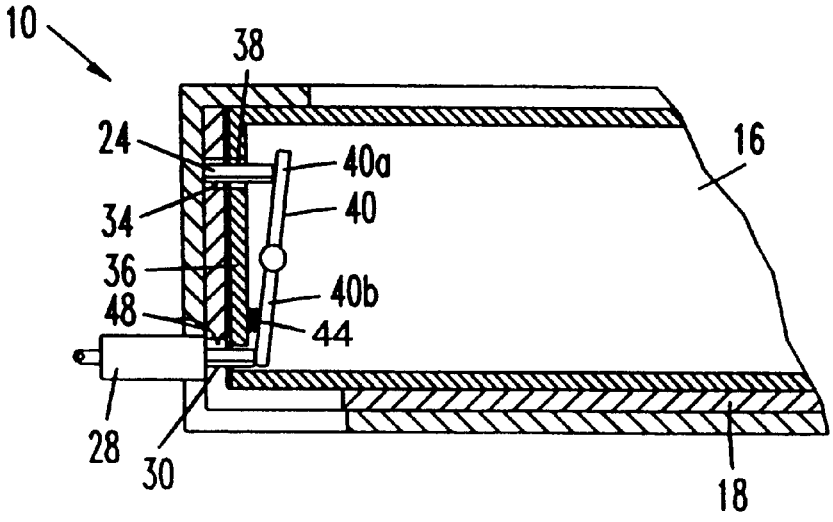
FIG. 2 shows a longitudinally sectioned view of the part of the holder with the interchangeable container in its inserted position in accordance with the first exemplary embodiment of the invention.

If the compartment 18 is moved in the insertion direction 20, the pin 24 moves into the interchangeable container 16 through the openings 34 and 38, and the switching pin 30 moves into the interchangeable container 16 through the openings 46 and 48, approximately simultaneously. In the process, the pin 24 encounters the upper arm 40*a* of the pivoting lever 40 and deflects the latter counter to the force of the compression spring 44. At the same time, its lower arm 40*b* is pivoted in the direction of the side wall 36 of the interchangeable container, which moves the switching pin 30 of the switch 28 as soon as the compartment 18 is resting on the inner surface of the side wall 22 of the frame 12 (FIG. 2). With this movement of the switching pin 30 of the switch 28, an electrical circuit (not illustrated) is closed, and controls the enabling of the inkjet printer for printing operations. Only when the circuit is closed will the inkjet printer be enabled. The maximum possible operating travel of the switching pin 30 is defined in such a way that it must in any case pass through the openings 46, 48 before the left-hand side wall 32 of the compartment 18 is resting on the frame 12.

It is also possible to put the interchangeable container 16 directly into the frame 12. The compartment 18 and, with the latter, the openings 34 and 48 can then be omitted.

Figure 3:
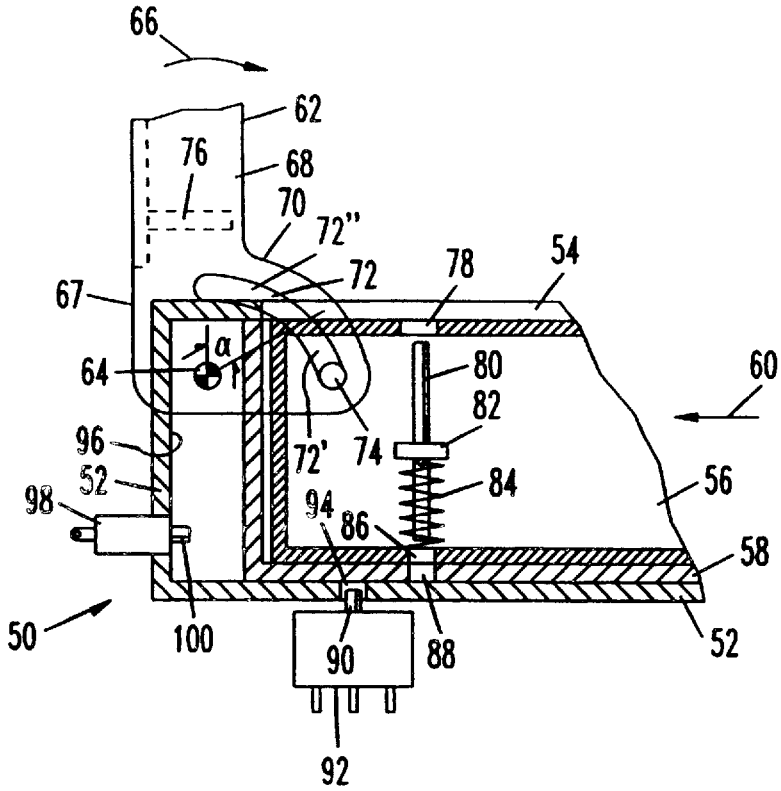
FIG. 3 shows a longitudinally sectioned view of a part of a holder with an interchangeable container in its released position in accordance with a second exemplary embodiment of the invention.

FIG. 3 shows a holder 50 for use in an inkjet printer according to a second exemplary embodiment of the invention. As viewed in longitudinal section, the holder 50 has a rectangular frame 52 with an insertion opening 54 on its upper side for the insertion and withdrawal of an interchangeable container 56. During the insertion operation, the interchangeable container 56 is firstly put loosely from above into a compartment 58 which is arranged inside the frame 52 and can be displaced in the latter in a horizontal insertion direction 60.

Arranged at the end of the frame 52 which is on the left in the illustration of FIG. 3 is a closing lever 62, which is mounted such that it can be rotated about an axis of rotation 64 fixed to the frame. The closing lever 62 may be part of a closure cap (not illustrated further) for the insertion opening 54. The 35 axis of rotation 64 of the closing lever 62 runs horizontally and, at the same time, transversely with respect to the insertion direction 60. FIG. 3 shows the closing lever 62 in an opened position, in which it extends upward vertically. As viewed from above, it has a rectangular profile with a long side 67 extending transversely with respect to the insertion direction, and a largely rectangular transverse side 68 which faces the observer and broadens only at its lower end in the shape of a curve 70 which encloses the axis of rotation 64, the curved edge pointing in the direction opposite the insertion direction 60.

Formed in this broadened portion of the transverse side 68 is a guide slot 72, which extends essentially parallel to the curved edge 70. The guide slot 72 has an end close to the axis of rotation and an end remote from the axis of rotation. The guide slot 72 approaches the axis of rotation 64 continuously in a portion 72', starting from its end remote from the axis of rotation 64, and at a point corresponding to a pivoting angle $\alpha$ of the closing lever 62, merges into a second portion 72" which extends circularly around the axis of rotation 64. In the opened position of the closing lever 62 illustrated in FIG. 3, the near end of the guide slot 72 is located above the axis of rotation 64 and at the same height as the latter, as viewed in the insertion direction 60. The end of the guide slot 72 which is remote from the axis of rotation 64 is, by contrast, located to the right of the axis of rotation 64 and is at the same vertical height as the latter. A guide pin 74 engages in the guide slot 72, at that end of the guide slot 72 which is remote from the axis of rotation 64 when the closing lever 62 is in the opened position. The guide pin 74 is formed on that side surface of the compartment 58 which faces the observer but is not illustrated in FIG. 3.

The guide pin 74 can alternatively also be arranged on the interchangeable container 56. In this case, the guide slot 72 is open at its end remote from the axis of rotation 64, so that it can be disengaged from the guide pin 74 for the insertion and removal of the interchangeable container 56 into and from the compartment 58. This is particularly advantageous when—according to an alternative embodiment of the holder 50—the compartment 58 is dispensed with and the interchangeable container 56 is put directly into the frame 52.

On the inner surface of its long side 67 which points to the right in the illustration of FIG. 3, the closing lever 62 has a signal transmitter in the form of a pin 76, which protrudes approximately vertically from said pin. Its vertical position on the closing lever 62 is determined by the fact that, in the event of a pivoting movement of the closing lever 62 in the direction 66, it moves into an opening 78 arranged on the upper side of the interchangeable container 56. This will be discussed in more detail below.

Mounted in the interchangeable container 56 such that it can be moved in the axial direction is a transmitting device in the form of a pin 80 which has a vertical longitudinal axis whose imaginary extension runs approximately through the center of the opening 78. For this purpose, a web 82 having an opening enclosing the cross section of the pin 80 is fixed to an inner wall of the interchangeable container 56. The pin 80 is held, with the aid of a helical compression spring, which is fastened at its upper end to said pin and at its lower end rests on the underside of the container 56, in a position in which its upper end is arranged approximately underneath the opening 78 and its lower end is arranged approximately above an opening 86 in the underside of the interchangeable container 56, said opening being arranged in extension of the pin.

Figure 4:
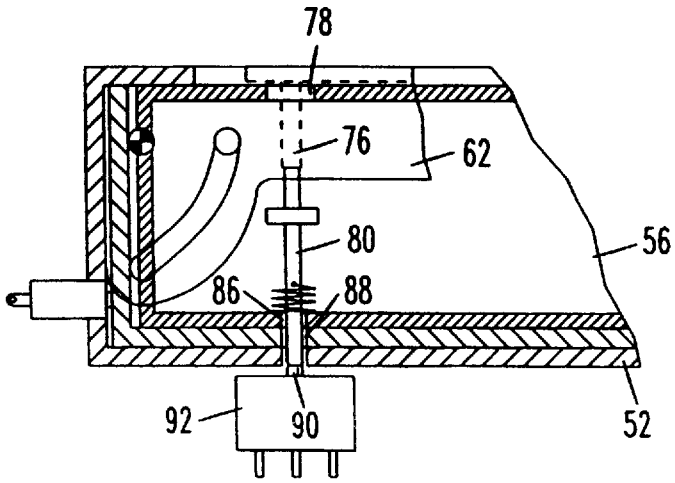
FIG. 4 shows a longitudinally sectioned view of the part of the holder with the interchangeable container in its inserted position in accordance with the second exemplary embodiment of the invention.

An opening 88 on the underside of the compartment 58 is aligned with an opening 94 in the bottom of the frame 52 when the compartment 58 is located in the position shown in FIG. 4. A signal receiver in the shape of a switching pin 90 and belonging to a switch 92 arranged underneath the frame 52 and projects into the opening 94, without projecting into the interior of the frame 52. In terms of construction and functioning, the switch 92 corresponds to the switch 28 described with reference to the first exemplary embodiment.

In order to insert the interchangeable container 56 put loosely into the frame 52, the closing lever 62 is pivoted in the direction 66. In the process, as is known from slotted guides of this or similar type, the guide pin 74 is used to exert a force, acting in the insertion direction 60, on the compartment 58 or the interchangeable container 56, so that the interchangeable container 56 and the compartment 58 are moved together in the insertion direction 60. After the pivoting lever 62 has been pivoted through the angle $\alpha$ the interchangeable container 56 is located in its working position shown in FIG. 4. If the pivoting lever 62 is pivoted further in the direction of the arrow 66, the pin 76 arranged on the pivoting lever 62 engages in the opening 78 on the upper side of the interchangeable container 56, comes into contact with the upper end of the pin 80 in the interchangeable container 56 during further movement of the pivoting lever 62, and presses said pin, counter to the spring force, downward and successively into the opening 86, the opening 88 located in the compartment 58 and against the switching pin 90 of the switch 92. In the position which is illustrated in FIG. 4 and in which the interchangeable container 56 has been inserted completely into the holder 50, and the pivoting lever 62 is located parallel to the upper side of said container, the pin 80 operates the switch 92 and in this way completes an electrical circuit explained with reference to the first exemplary embodiment, by which means the inkjet printer is enabled to print.

The side wall 96 of the frame 52 which is on the left in FIGS. 3 and 4 has a further switch 98 inserted into it in such a way that its switching pin 100 projects into the interior of the frame 52. In the position illustrated in FIG. 4, the further switch 98 is operated by the left-hand side wall of the compartment 58 or, if the latter is omitted, by the left-hand side wall of the interchangeable container 56.

By means of a logical combination of the switching states of the switches 92 and 98, a security concept is implemented as follows: if an interchangeable container 56 is to be put into the compartment 58, the switches 92 and 98 must be unoperated. After the interchangeable container 56 has been put in and the closing lever 62 has been pivoted into the closed position, the switch 92 is operated first, and the further switch 98 is operated only later. Only in the case of this chronological sequence of the switching edges will the printer be enabled. This therefore prevents a manipulation to the effect that one of the switches 92, 98 is blocked in its operated position, and in this way a proper interchangeable container is feigned.

The above-described security concept can also be used in the case of the holder 10 in the first exemplary embodiment, as illustrated in FIGS. 1 and 2. It is a precondition that a further switching element, corresponding to the further switching element 98 in terms of arrangement and function, is provided.

Figure 5:
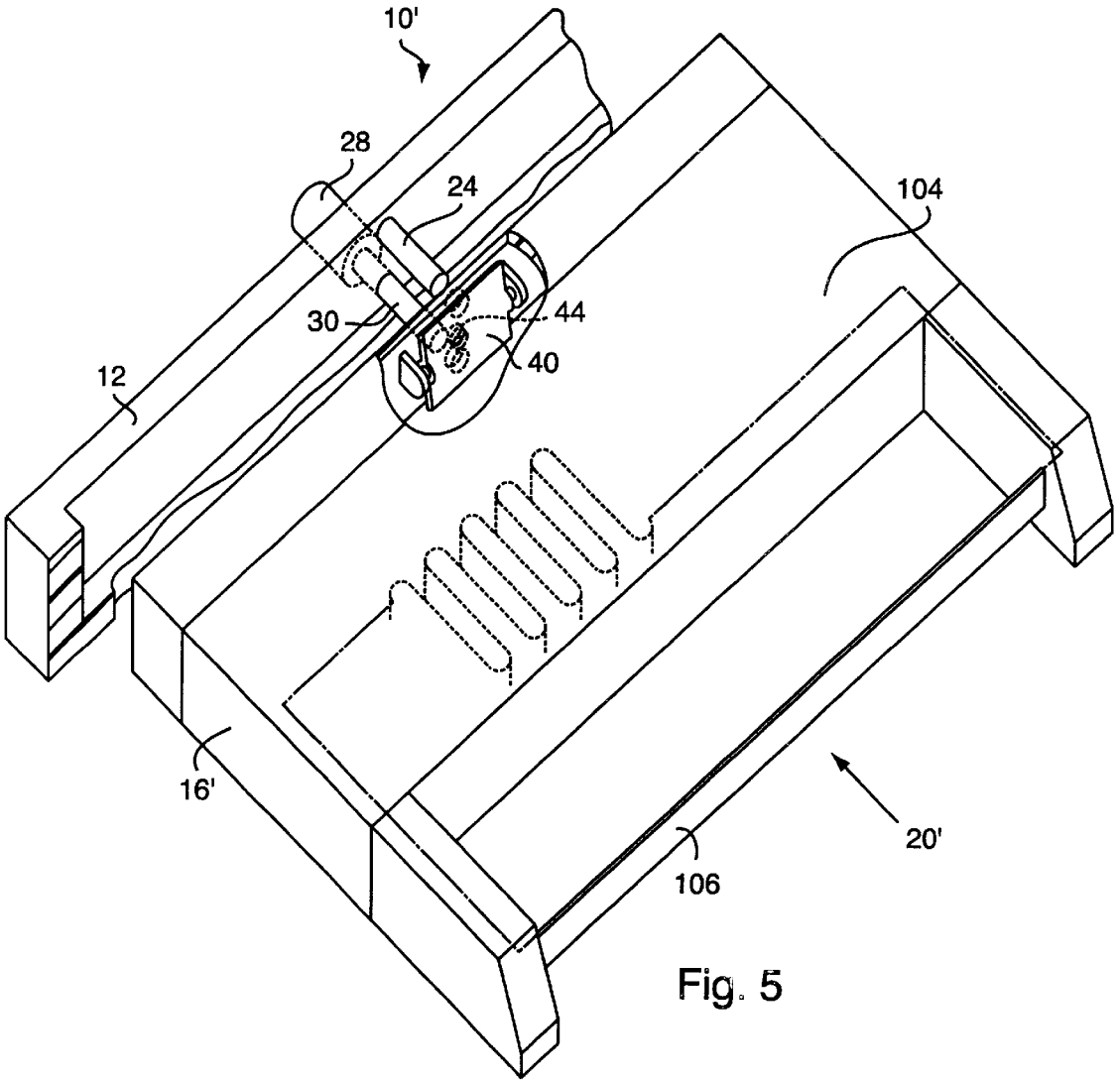
FIG. 5 shows an alternative embodiment of the invention in which the interchangeable container is an ink ribbon cartridge.

As mentioned, the matrix printer with which an interchangeable ink cartridge of this invention instead of being an inkjet printer can also be a dot matrix printer wherein the ink is provided by way of an ink ribbon cartridge. Such an embodiment of the invention is shown in FIG. 5 wherein an ink ribbon container or cartridge 16' having an ink ribbon 106 and an ink ribbon reservoir 104 is held in use by a holder 10', with the cartridge 16' being moved in the direction 20' to bring it into the position at which it is held in use by the holder 10'. The illustrated parts of FIG. 5 called out by primed referenced numbers correspond respectively to the parts of FIGS. 1 and 2 called out by the same unprimed reference numbers, so the signalling functions performed as the ink ribbon cartridge 16' are moved onto the holder 10'is the same as those performed when the interchangeable container 16 of FIGS. 1 and 2 is moved onto the holder 10.

What is claimed is:

1. A matrix printer having a moveable print head, at least one interchangeable ink container for a printing-ink supply and having an interior space free of printing ink, and a holder to hold the interchangeable container, a means for preventing operation of the printer with an improper ink container, said means comprising:

a first switch to block and enable the printing operation, a mechanical signal transmitter and a mechanical signal receiver arranged on the holder, and a mechanical signal transmitting device arranged in the interior space of the interchangeable container for transmitting a mechanical input signal from the mechanical signal transmitter to the mechanical signal receiver during or upon an insertion of the interchangeable container into the holder, the signal transmitter during the insertion of the interchangeable container being moveable into the interior space of the interchangeable container through an opening in a wall of the interchangeable container, said signal receiver being associated with said switch so that an input signal from the signal transmitter is transmitted to the signal receiver by the signal transmitting device and is converted to an output signal applied to the signal receiver and through the signal receiver to the switch.

2. The combination defined in claim 1, wherein:

the signal transmitter is a pin on a side of the holder which faces a surface of the interchangeable ink container which points in an insertion direction of the container, the signal transmitting device is a two-armed pivoting lever with an axis of rotation running transversely with respect to the insertion direction and on one arm of which lever the pin acts, said signal receiver is a switching pin of the switch arranged on the same side of the holder as the pin and operated by a second arm of the pivoting lever, said switch being pre-stressed to an unoperated condition.

3. The combination claimed in claim 2, wherein:

the switching pin projects through a wall of the holder and, when an interchangeable ink container is moved into a working position, penetrates into the interior space of the interchangeable ink container through an opening in the surface pointing in the insertion direction.

4. The combination claimed in claim 1, wherein:

on the holder there is provided a compartment to hold the interchangeable container, said compartment being movable between a holding position and a locked position, in which locked position a mechanical signal is transmitted from said signal transmitter to said switch.

5. The combination claimed in claim 1, wherein:

the printer is an inkjet printer, and the interchangeable container is designed to hold printing ink.

6. The combination claimed in claim 1, wherein:

the printer is a dot matrix printer, and the interchangeable container is designed as an ink ribbon cartridge.

7. The combination claimed in claim 1, wherein:

on the holder there is provided a pivoting closing lever for locking the interchangeable container in the holder and having a signal transmitter in the form of a pin for operating the signal transmitting device, with said signal transmitter pin being so arranged on the lever that in a closed position of the closing lever, the signal transmitter pin, the signal transmitting device, and the signal receiver are arranged along a straight line of action, so that movement of said signal transmitting device is transmitted along said straight line of action from said signal transmitter pin, through the signal transmitting device, to the signal receiver.

8. The combination claimed in claim 7, wherein:

an opening is let into the bottom of the holder, and the signal receiver is a switching pin of the switch, which switching pin is aligned with the opening and which switch is located underneath the bottom of the holder.

9. The combination claimed in claim 1, wherein:

a second switch is incorporated in a side wall of the holder which second switch limits the insertion movement of the interchangeable container and has a switching pin which projects into the interior of the holder and is moved with the interchangeable container as the interchangeable container is moved in the insertion direction as the container is inserted into the holder.

10. The combination claimed in claim 9, wherein:

before an interchangeable container is put into the holder both of said first and second switches are unoperated, during the insertion movement, the first switch and then the second switch are operated, and the printer is enabled only after this chronological sequence of switch operations occurs.

11. An interchangeable container for a printing-ink supply for a matrix printer having a mechanical signal transmitter and a switch that can be operated to control the enabling of printing, the interchangeable container comprising:

a body with a wall having an opening for receiving the signal transmitter of the printer, as an input signal, when the interchangeable container is inserted into the printer, and a mechanical signal transmission element carried by said body and operable by said transmitter when the interchangeable container is inserted into the printer for transmitting said input signal to said switch as an output signal from the interchangeable container which output signal operates the switch to enable printing by the printer.

12. The interchangeable container claimed in claim 11, wherein:

the signal transmission element is provided inside the interchangeable container body, and the input signal and the output signal appear at a common wall of the interchangeable container.

13. The interchangeable container claimed in claim 11, wherein:

said interchangeable container is an ink supply container for an inkjet printer.

14. The interchangeable container claimed in claim 11, wherein:

said interchangeable container is an ink ribbon cartridge.

* * * * *